United States Patent [19]

Sun

[11] Patent Number: 4,811,775

[45] Date of Patent: Mar. 14, 1989

[54] APPARATUS FOR PREVENTING CRIMINAL'S ESCAPE OR VIOLENCE

[76] Inventor: Shin-Ching Sun, 3F., No. 32, 132nd Lane, Hu-Lin St., Taipei, Taiwan

[21] Appl. No.: 157,235

[22] Filed: Feb. 18, 1988

[51] Int. Cl.[4] ..... E05B 75/00

[52] U.S. Cl. ..... 70/16; 361/232

[58] Field of Search ..... 70/16, 15, 17; 361/232; 119/145; 109/35

[56] References Cited

U.S. PATENT DOCUMENTS 4,089,195 5/1978 Lai ..... 70/16

4,370,696 1/1983 Darrell ..... 361/232

*Primary Examiner*—Robert L. Wolfe

[57] ABSTRACT

The present invention relates to an apparatus for preventing criminal's escape or violence. This apparatus comprises an action box which is united on the criminal's handcuff or fetter and which can endure any general bump or knock and will not be transformed or damaged. There are installed wireless receiving circuit, shock device circuit, buzzer device circuit and battery on the PC board in the action box. The afore-said action box can receive shock order code that is ordered by the control box in the executor's hand. On contrary, when the action box can not receive the signal code, it will sound warning and order shock device to actuate shock to prevent the criminal's escape or violence. Besides, present invention can achieve the purposes of increasing police's safety and saving police's strength.

3 Claims, 2 Drawing Sheets

APPARATUS FOR PREVENTING CRIMINAL'S ESCAPE OR VIOLENCE

FIELD OF THE INVENTION

The present invention is an apparatus for preventing a criminal's escape or violence, it is particularly a wireless telecontrol shock apparatus united on the criminal's handcuff or fetter to prevent his escape or doing violence to the police.

BACKGROUND OF THE INVENTION

Nowadays, police are equipped with the arrest equipment without any particular or improved function. If the police arrests a criminal with the conventional handcuff, he is most often manacled together with the criminal. Therefore, there are limitations based on the policeman's strength to what extent the criminal's action can be bound, and it frequently happens that the criminal escapes or does violence to the police. Owing to such defects, police prevents the criminal's escape or violence is used by large members, so that police are usually required eagerly. If the police member is equal to the criminal member, it is difficult to prevent the criminal's escape or violence.

SUMMARY OF THE INVENTION

According to the present invention, an apparatus for preventing criminal's escape or violence comprises a steel housing, an inner housing, a wireless receiving circuit, a shock device, a buzzer device and a lock. They are provided in the aforesaid steel housing to be connected on the handcuff or fetter, and make them become conductive to provide locking the criminal's wrist or leg. An executor can take the wireless control box to control and prevent the criminal from escaping or doing violence. When the criminal wishes to escape far from the set distance of the present invention, present invention can discharge automatically shock and sound a warning to make the criminal temporarily lose his ability to act. At that time, the executor can easily and safely recapture or secure the criminal. On contrary, if the criminal does not go far from the set distance of present invention but wishes to do violence to the executor, now the executor can push down the shock control switch on the control box in his hands to make the shock device connected to the criminal's handcuff or fetter discharge a shock to stop the criminal's action. Therefore, it will achieve the function of increasing the executor's safety and, in the meantime, saving the police strength, and will prevent a criminal's escape or violence.

SPECIFIC DESCRIPTION

Figure 1:
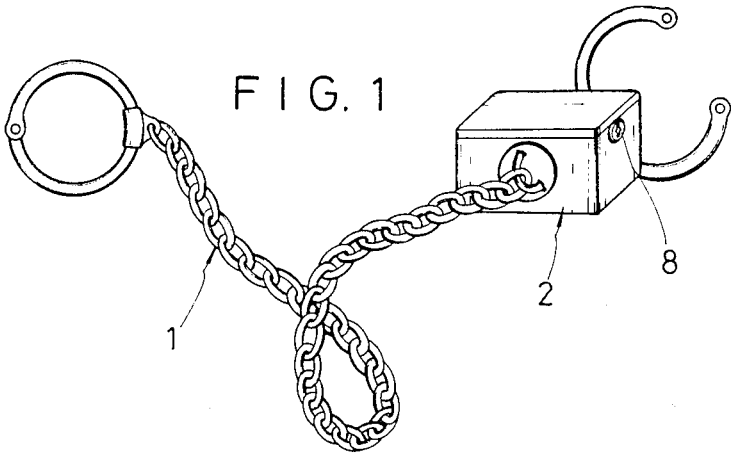
FIG. 1 is an appearance perspective view for the structure of present invention.
Figure 2:
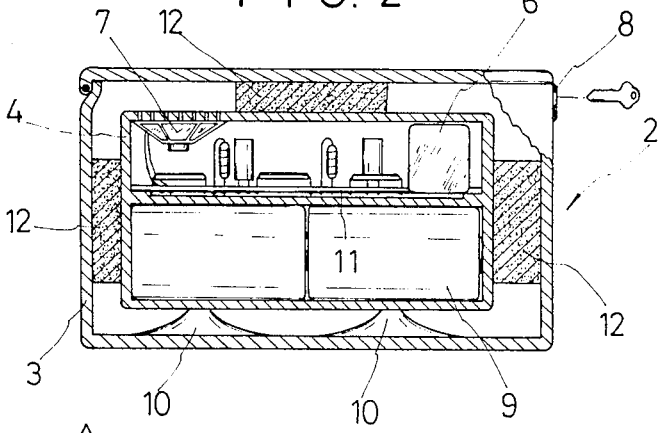
FIG. 2 is a sectional view of the action box of present invention.
Figure 3:
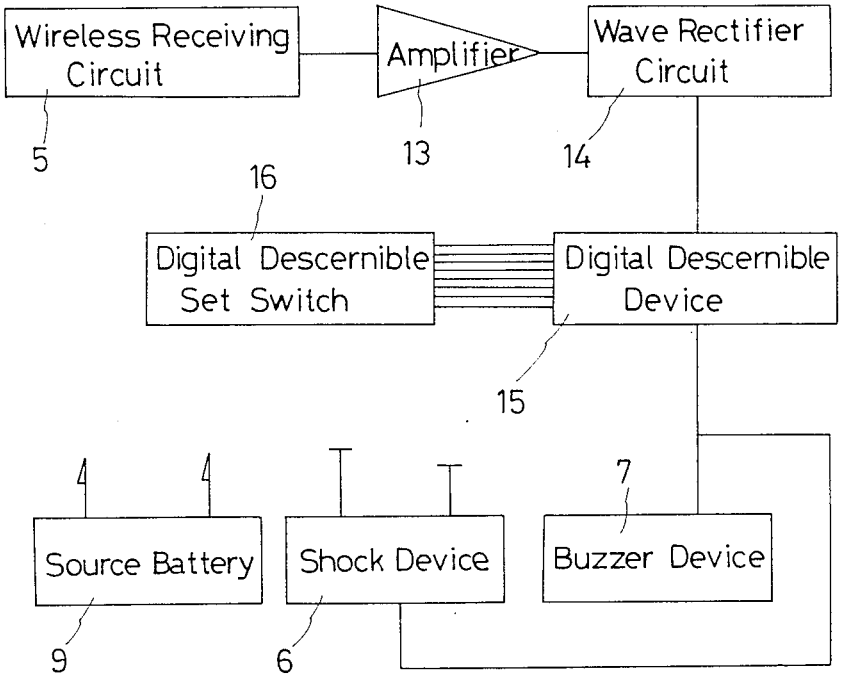
FIG. 3 is a block diagram of the wireless receiving circuit and shock sevice in the action box of present invention.

As showing in FIGS. 1 and 2, handcuff or fetter 1 is a main portion of present invention and connected with action box 2. The action box 2 comprises steel housing 3, inner housing 4, wireless receiving circuit 5, shock device 6, buzzer device 7, lock 8 and source battery 9. The steel housing 3 is made by pressing or welding of a suitable alloy steel and has high hardness and strength after the heat treatment; it can endure any general bump or knock and will not be transformed or damaged. Lock 8 will be locked after the uniting of the housing and the housing cover, so that the criminal can not open it and it will be kept completely closed. Inside steel housing 3 there is provided inner housing 4 which is smaller than steel housing 3 and is made of an insulating material. The outer rim of the bottom of inner housing 4 is united with several suction disks 10 to suck the inner bottom rim of steel housing 3. The said suction disks 10 do not only have their conventional function but also have the function of buffing the buffet to make the buffet of steel housing 3 not be transmitted directly to PC board 11 installed in inner housing 4. Besides, at the other sides of inner housing 4 there glued some buffer sponge pieces 12 to keep the electric elements away from damage caused by bumping the box. Inside inner housing 4 there is installed PC board 11 which comprises wireless receiving circuit 5, the circuit of shock device 6, the circuit of buzzer device 7 and source battery 9. The antenna portions of said receiving circuit 5 and the discharge shock portion of said shock device 6 are connected with steel housing 3. The operation proceeds as shown in FIG. 3. When the receiving circuit 5 receives the wireless signal from handcuff or fetter 1 and steel housing 3, it receives a serial discernible signal code, then amplifier 13 amplifies the signal, and wave rectifier circuit 14 rectifies. At that time, the signal will be transmitted to the digital discernible device 15 to proceed the work of discernment and to be compared with the signal set originally at the digital discernible set switch 16. If the discernible code is received correctly but without any shock order, then the control signal will not be generated and transmitted to shock device 6, and shock device 6 will not discharge a shock. On the contrary, if the signal can not be received or if the shock order is received, the descernible device will put out the order signal to shock device 6 to discharge and make buzzer device 7 sound a warning. The source battery 9 provides the required electricity for the circuit.

Figure 4:
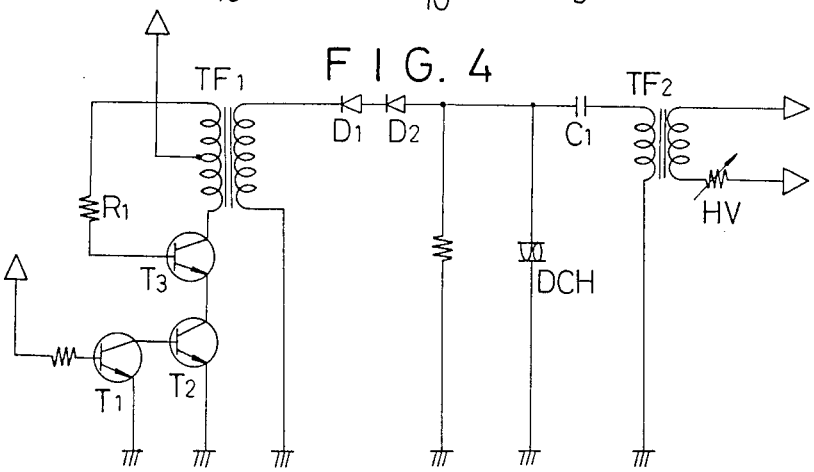
FIG. 4 is a circuit diagram of the discharge portion of present invention.

In FIG. 4, the signal judged by afore-said digital discernible device 15 actuates shock device 6 and buzzer device 7. This signal is a change of voltage standard. That is, when the shock signal is judged and output, a signal which is transferred from the low voltage standard to the high voltage standard will be generated. At that time, T1 and T2 will be conducted. T3, TF1 and R1 are ascended the circuit with from 9 voltage D.C. to about 1,000 A.C. by the buffeting on D.C. or the potential of A.C., then rectified with half-wave by D1 and D2 into D.C. or D.C. standard forward C1 to recharge. The potential of C1 ascends continuely at that time, and when it reaches to the discharge of the discharge piece, the discharge piece discharges to make the electric load of C1 pass to discharge TH2 primary, and C1 does capacitance to the other end to generate the instant and big electricity to flow through TF2 primary. At that time, Tf 2 secondary reflects the potential and becomes an ascending transformer to generate the potential with about 20–30 thousand high voltage. Then, at the two shock ends there produces sparks and discharge statement. Although the voltage is high, yet it is an instant action, that is the discharge action of C1 only acts in a very short time. Besides, the whole circuit exhausts D.C. about 9 voltage and potential about 200–300 mA. When the potential ascends to 20–30 voltage, there, in fact, generates the current is a little at the electrode end by the exchange of energy and adding loss in the circuit. It is just only to terrify and shake the criminal, and will not hurt anyone. Furthermore, the present invention is united with handcuff and fetter, and used on the criminal's four limbs and far apart human important organs, so that will not do any hurt to the criminal. In the meantime, a high adjusting resistance which can have its value set in advance is installed at the two ends of output portion. The shock can thus be set to be strong or weak as required by the criminal's health characteristics. The present invention really has the good practical application. PC board 11 of present invention is a kind of glassfiber board and is treated by the water proof covering, so it operates with high trustworthiness.

Circuit of two output ends of afore-said high potential shock device 6 is provided near by handcuff or fetter 1. That is, the high potential does not pass through the most portions of the human body, it occurs at the place between said two output ends, and makes the circuit at that two ends, so that will not generate a big circuit. If the executor touches the criminal, he will not be hurt because that circuit does not generate to him.

Figure 5:
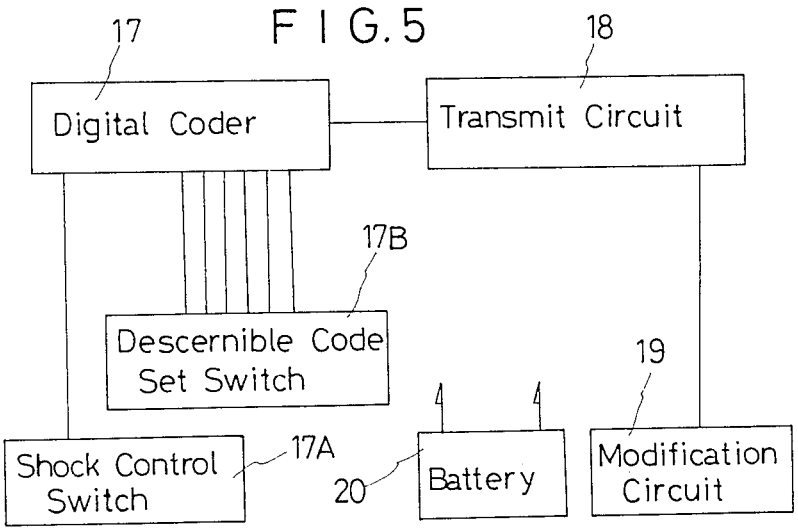
FIG. 5 is a block diagram for the structure of the wireless control box of present invention.

The wireless control box of the present invention (see in FIG. 5) comprises digital coder 17, shock control switch 17A and discernible code set switch 17B. It can generate a serial electric code signal to transmit circuit 18. If the shock control switch 17A is pushed down, the shock signal can be added in electric code signal. When transmit signal is changed from the buffeting signal of control box itself to modification circuit 19, it transmits outward by way of circuit antenna. Battery 20 provides the required electricity for said circuit.

The effective distance of present invention can be set as required, and it can be decided by the power of said transmit circuit 18 to be its effective radius. That is, if the power is big, the radius increases in response. As to the shock time, long or short, it can be set in the circuit during manufacture.

I claim:

1. An apparatus for preventing a criminal's escape or violence comprising:

A. an action box connected to a handcuff or fetter, which comprises:

a steel housing made of alloy steel and forming a center hollow, which is able to endure any general bumps or knocks without being transformed or damaged, the housing being connected with a housing cover by closing a lock provided thereon;

an inner housing installed in said steel housing, which is made of an insulating material and forms a center hollow box, an outer rim of a bottom of the inner housing is provided with several suction disks to suction an inner bottom rim of said steel housing to buffer vibrations generated by bumping or knocking said steel housing, buffer sponge pieces being glued to other sides of said inner housing;

an integrated circuit board provided in said inner housing comprising a wireless receiving circuit for receiving a signal; a shock control circuit for controlling the generation of a shock, a buzzer device circuit for sounding a warning and a source battery for supplying power to the circuits; and B. a control box held and used by an executor comprising a wireless transmit circuit for transmitting said signal and a shock control switch for generating a set shock order code and causing a shock to be generated.

2. An apparatus for preventing criminal's escape or violence according to claim 1, wherein:

the signal and the code generated by the wireless transmit circuit in said control box is adjustable, and when the shock control switch is depressed the set shock order code is transmitted, the wireless receiving circuit of the action box being used to receive the signal and code transmitted by the control box, its receiving activity and code being adjustable; and when the receiving circuit receives the set shock order code transmitted by the transmit circuit, or does not receive the signal and code of the transmit circuit, the buzzer device sounds a warning and the shock device is ordered to actuate a shock.

3. An apparatus for preventing criminal's escape or violence according to claim 1 wherein two output ends of said shock device forming the circuit are near the handcuff or fetter.

* * * * *